United States Patent [19]

Breitenkam et al.

[11] 4,176,941

[45] Dec. 4, 1979

[54] MALFUNCTION DISPLAY SYSTEM FOR ELECTROPHOTOGRAPHIC COPYING MACHINES

[75] Inventors: Fred J. Breitenkam, Randolph; James E. Landrith, Andover, both of N.J.

[73] Assignee: Van Dyk Research Corporation, Whippany, N.J.

[21] Appl. No.: 881,195

[22] Filed: Feb. 27, 1978

[51] Int. Cl.[2] ..... G03G 15/00; B65H 7/02

[52] U.S. Cl. ..... 355/14 R; 271/259; 340/675; 355/3 SH

[58] Field of Search ..... 355/3 R, 3 CH, 3 SH, 355/3 TR, 14; 271/259; 340/673, 675

[56] References Cited

U.S. PATENT DOCUMENTS

| | | | |
|---|---|---|---|
| 3,675,228 | 7/1972 | Iwamoto | 340/675 |
| 3,806,242 | 4/1974 | Reehil | 340/675 X |
| 3,831,933 | 8/1974 | Fantozzi | 271/258 |
| 3,878,540 | 4/1975 | Kawai | 355/14 X |
| 3,900,740 | 8/1975 | Akimoto et al. | 355/14 X |

*Primary Examiner*—Fred L. Braun
*Attorney, Agent, or Firm*—Arthur L. Lessler

[57] ABSTRACT

A mechanical schematic diagram showing the paper flow path through a xerographic copying machine and an associated sorter is illuminated when a paper jam occurs or when the supply of paper, toner or fuser oil is depleted. At the same time the copier is shut down and a flashing light on the diagram at the approximate location of the problem source is illuminated. Steadily illuminated lights indicate the positions of paper sheets which must be removed from the machine before normal operation can resume. Depleted consumable items are also identified by flashing lights indicating the location of the cause of the interruption. Thus the machine operator is immediately able to determine the cause of the interruption and the corrective action required.

7 Claims, 3 Drawing Figures

SHEET A

SHEET B

MALFUNCTION DISPLAY SYSTEM FOR ELECTROPHOTOGRAPHIC COPYING MACHINES

This invention relates to a malfunction display system utilized in combination other sensors an electrophotographic copying machine.

Electrophotographic copying machines in general, and high speed xerographic copiers in particular, are subject to occasional paper jams, i.e., failure of paper sheets to properly travel along a predetermined paper flow path within the machine. Because of the relatively great length of the paper path in a high speed xerographic copier, and especially in a copier utilized with an associated sorter, several sheets of copy paper upon which visible images are to be formed, may be travelling through the copying machine at the same time. It is not unusual to have as many as six or seven sheets of paper simultaneously moving along the paper flow path within the copying machine. When a malfunction occurs, i.e., a paper jam, sensors adjacent the paper flow path automatically shut down the copying machine, in a manner well known in the art.

It is then necessary for the machine operator to open the machine access doors, remove all of the paper sheets disposed along the paper path within the machine, close the access doors, and restart the machine, usually by pressing a "start" or "copier on" button.

Since it is not always easy for a relatively unskilled machine operator to visually detect all of the paper sheets disposed along the paper flow path, it is not uncommon for one or more sheets to be left in the machine. When this occurs, the operator's effort to restart the machine is futile, and the access doors must again be opened, with the operator searching for previously missed sheets along the paper path. Sometimes the operator is unsuccessful in this additional search, or does not realize the cause of the failure of the machine to restart, and a service man is summoned, resulting in an expensive and unnecessary service call.

Electrophotographic copying machines, and particularly xerographic machines, utilize consumable items such as paper, toner and fuser oil, which must be replaced or replenished when they are depleted. Although existing copying machines often have descriptive words which are illuminated when a consumable item requires replenishment, the meaning of such words is not always clear to an unskilled operator.

Accordingly, an object of the present invention is to provide a display arrangement for facilitating the performance of routine corrective and maintenance functions by a relatively unskilled copying machine operator, and to alleviate the aforementioned problems.

As herein described there is provided, in combination with an electrophotographic copying machine including: (a) means for utilizing copy paper and other consumable items and for moving sheets of said copy paper along a predetermined path through said machine while forming visible images on said sheets, (b) jam detection means for monitoring the movement of paper sheets along said path at preselected points thereof, and for generating (i) a jam occurrence signal indicative of the occurrence of a paper jam along said path, and (ii) a jam location signal indicative of that one of said preselected points at which the jam was detected; (c) paper detection means for sensing the presence of paper sheets at various points along said path and for generating a number of paper presence signals indicative of the locations of corresponding paper sheets disposed along said path, and (d) consumable item monitoring means for sensing the quantity of each of said consumable items and for generating a depleted consumable item identification signal indicative of each particular item which has been depleted to a quantity less than a predetermined value, a malfunction display system comprising: a pictorial display showing elements of said machine defining said paper path, said display including (i) paper path illuminating means for selectively illuminating portions of said display corresponding to each of said preselected points and each of said various points along said paper path, and (ii) consumable item symbols and means for selectively illuminating a point adjacent each of said symbols; malfunction display enabling means responsive to said jam occurrence signal and to said depleted consumable item identification signals for illuminating said pictorial display; jam display means responsive to said jam location signal for actuating said paper path illuminating means to distinctively illuminate the display portion corresponding to that one of said preselected points at which the jam was detected; paper presence display means responsive to corresponding ones of said paper presence signals for actuating said paper path illuminating means to distinctively illuminate portions of said display corresponding to those of said various points along said paper path at which paper sheets are present; and depleted consumable item display means responsive to said depleted consumable item identification signal for distinctively illuminating points adjacent those symbols corresponding to consumable items requiring replenishment.

Xerographic copying machines are well known in the art, and it is therefore unnecessary to describe such machines in any detail. Generally speaking, such copying machines employ a drum or belt with which plain paper is brought into contact, with a dry or liquid toner being transferred from the drum or belt to the paper to form a desired visible image. Heating means such as a fuser roller then heats the toner to set the image on the paper. A paper sorter may be associated with the copying machine to receive processed copies from the end of the paper flow path of the machine, and to sort said copies in a predetermined manner.

Xerographic copying machines of the aforementioned type employ a plurality of transport belts to move paper sheets through the machine along a predetermined paper flow path. The paper sheets may be fed into the machine by a sheet feeder, or alternatively may be cut to size within the machine from a continuous roll of paper. The latter arrangement is described, e.g., in U.S. Pat. No. 3,718,394.

Conventional xerographic copying machines also include micro-switches, photoelectric detectors and/or othersensors disposed at preselected points along the paper flow path to detect (i) paper movement anomalies indicative of paper jams and (ii) the presence of paper sheets at various points along the paper path. Where a paper roll is employed, additional sensors may be included to detect the depletion of paper from the roll (usually by monitoring the roll diameter with a suitable lever-operated switch) and the deviation of the paper web from a predetermined path of movement. An arrangement for detecting improper path positioning of a paper web in a xerographic copying machine is described, e.g., in U.S. Pat. No. 3,859,649.

It is also known in xerographic copying machines to provide a photoelectric, capacitive or other sensor to detect the level of toner in a toner dispenser within the machine, and to provide a warning signal when the toner is depleted and requires replenishment. Similarly, a float or other sensor is employed, in manner well known in the art, to provide a warning signal when lubricating oil for the fuser roller requires replenishment.

The display system herein described may be employed in conjunction with any electrophotographic copying machine having paper jam detectors, paper presence sensors, and consumable item sensors as described above.

Figure 1:
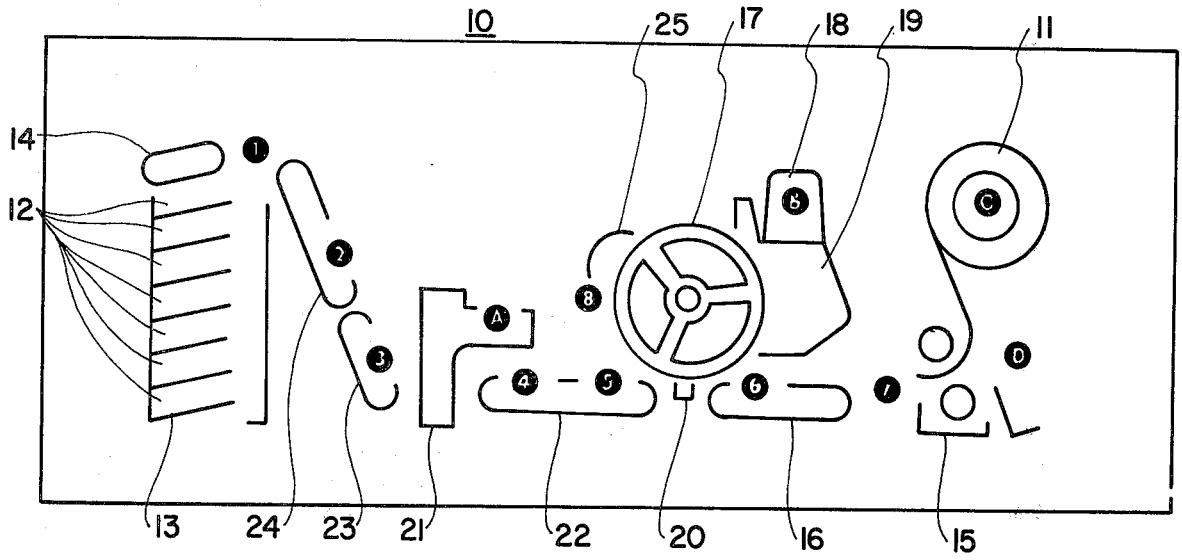
FIG. 1 shows a pictorial or mechanical schematic diagram of a display in accordance with a preferred embodiment of the present invention.

As shown in FIG. 1, a display 10 comprises a pictorial or mechanical schematic diagram showing the paper flow path through a xerographic copying machine. While FIG. 1 is drawn black-on-white, i.e., with black lines representing the functional elements of the machine on a white background, the actual display comprises an opaque black panel having transparent areas forming the lines defining the functional elements, i.e., the transparent areas correspond to the black lines in FIG. 1.

In the diagram of FIG. 1, paper flows through the copying machine from a supply roll 11 to various bins 12 of a sorter 13. A by-pass transport 14 routes paper sheets to a paper receiving tray (not shown) when sorter operation is not desired.

A transparent area in the center of the symbol for the paper roll 11 is denoted as "C" and may be selectively illuminated to indicate that the paper roll has been used up and should be replaced. Another transparent area "D" is disposed adjacent a web position sensor (not shown), and may be selectively illuminated to indicate that the paper web from the roll 11 is not properly positioned along its path of movement.

A paper cutting arrangement is schematically depicted by the symbols 15 at its approximate relative position in the machine. A transparent area 7 may be selectively illuminated to indicate that paper has failed to arrive at or leave the corresponding location in the copying machine at the proper time, i.e., indicating that a paper jam has occurred. The area 7 is illuminated in a repetitively flashing manner when a jam is detected at the corresponding machine location, and is steadily illuminated to indicate that paper is present at the location 7, when a paper jam is detected at another point along the paper flow path.

After paper is cut into sheets by the cutter denoted as the symbols 15, the paper sheets are moved by the transport symbolized at 16 into contact with the xerographic drum symbolized at 17, where toner from the dispenser symbolized at 18 is applied to the drum 17 via the developer tank symbolized at 19, and is transferred from the drum 17 to form a visible image on the paper sheets, by the transfer corona electrode 20.

A transparent region 6 adjacent the transport symbol 16 may be selectively illuminated to indicate the presence of paper on said transport when a jam is detected.

The transparent region B may be selectively illuminated to indicate that the supply of toner within the dispenser represented by the symbol 18 requires replenishment.

Paper sheets leaving the transfer region adjacent the corona electrode 20 are moved to the fuser region represented by the symbol 21, by the transport represented by the symbol 22. Transparent regions 4 and 5 may be selectively illuminated to indicate the presence of paper sheets on corresponding portions of the transport 22, and the region 5 may be illuminated in a flashing manner to indicate the occurrence of a paper jam at the corresponding machine location.

The transparent region A may be illuminated to indicate that the supply of lubricating oil for the fuser 21 requires replenishment.

Paper sheets leaving the fuser 21 are moved to the sorter 13 by adjacent transports symbolized by the elements 23 and 24. Transparent regions 1, 2 and 3 adjacent the sorter 13, transport 24 and transport 23 respectively may be illuminated to indicate the presence of paper sheets at corresponding points in the machine, while transparent regions 1 and 3 may be illuminated in a flashing manner to indicate that a paper jam has been detected at the corresponding machine location.

A sorter coupled to a copying machine via transports arranged in a similar fashion to transports 23 and 24, is described in U.S. Pat. No. 3,988,018.

Excess toner remaining on the drum 17 after traversal of the transfer electrode 20, is removed by a cleaning element symbolized at 25. A transparent area 8 adjacent the element 25 detects the presence of paper improperly adherent to the drum 17, i.e., a paper jam.

In the foregoing discussion reference numerals denoting symbols corresponding to actual copying machine elements have been employed more or less interchangeably with the elements themselves, and it is not believed that this manner of description will cause any confusion.

Thus the transparent regions 1, 3, 5, 7 and 8 serve a dual function, i.e., they may be illuminated in a flashing manner to indicate the detection of a paper jam, or they may be steadily illuminated to merely indicate the presence of a paper sheet at the corresponding machine location. While the mere presence of paper adjacent the region 8 is indicative of a paper jam, and the mere presence of paper at the region 1 (i.e., paper sheets which fail to traverse the top guide of the sorter) also indicates that a jam has occurred, paper jams at the regions 3, 5 and 7 are detected, in well-known manner, by determining that the time required for a corresponding paper sheet to move to or from said location is improper.

The spacings between the transparent areas 1 through 8 are such that adjacent areas are spaced by a distance greater than the maximum sheet length, so that each transparent area is capable of detecting the presence of a separate paper sheet. Thus the areas 1 through 8 are capable of detecting not only paper jams but also the presence of up to eight separate sheets of paper along the paper flow path within the copying machine, viz., the maximum number of separate sheets which can be disposed in non-overlapping fashion along the paper flow path at any given time.

The various functional elements depicted on diagram 10 may be simultaneously illuminated, when a malfunction (i.e., a paper jam or depletion of a consumable item such as paper, toner or fuser oil) occurs. Preferably, the functional elements of the diagram 10 are then illuminated in a neutral color such as white.

If the malfunction was a paper jam, the corresponding one of the regions 1, 3, 5, 7 and 8 is illuminated in a flashing manner by a red light. At the same time, those of the locations 1 through 8 at which paper sheets are present, are steadily illuminated by red lights.

If the malfunction was caused by depletion of a consumable item, the corresponding region A, B or C is illuminated by a flashing yellow light. If the malfunction was due to improper web position adjacent the transparent area D, this area is likewise illuminated by a flashing yellow light.

Thus by merely looking at the diagram 10, the machine operator may quickly visually determine both the cause of the machine stoppage (the copying machine automatically stops when a malfunction is detected, in conventional fashion) and the corrective action required, and may also determine the locations of all paper sheets which must be removed from the machine before normal operation may be resumed.

As each paper sheet is removed by the operator, after the machine access doors have been opened, the corresponding ones of those regions 1 to 8 which have been illuminated, are extinguished. The display 10, however, will continue to be illuminated and the light indicating the location at which the paper jam was detected will continue to flash, until the machine access doors are closed and the operator causes the machine to resume normal operation, i.e., by pressing a "start" or "copier on" button. At that time the flashing light will extinguish and the entire display will cease to be illuminated.

When a consumable item is replenished, or the paper web is properly repositioned, the corresponding flashing yellow light at one of the regions A to D will extinguish, and the display 10 will cease to be illuminated. Normally, the copier control circuitry will continue to run the machine to clear it of internal paper sheets when a consumable item is depleted, causing machine shutdown. However, of for any reason any sheets remain in the machine, the presence of such sheets will be indicated by corresponding ones of the lights 1 to 8.

Thus the display 10 is illuminated only when a malfunction occurs, and ceases to be illuminated when the malfunction has been corrected. This arrangement immediately alerts the operator to the existence of a malfunction and the steps required to correct it, and avoids disturbing the operator during normal machine operation.

The functions of the various indicators, and the remedial action required, as described above, are summarized in Table I below:

TABLE I

| | REMEDIAL ACTION REQUIRED |
|---|---|
| FLASHING RED INDICATOR | |
| 1 Jam (paper did not traverse top guide of sorter) | Remove paper from top guide |
| 3 Jam (paper delayed in arriving at location 3) | Remove paper from fuser |
| 5 Jam (paper delayed in arriving at location 5) | Remove paper from drum |
| 7 Jam (paper delayed in arriving at or leaving location 7) | Remove paper and reposition paper web |
| 8 Jam (paper adhered to drum) | Remove paper from drum |
| STEADILY ILLUMINATED RED INDICATORS | |
| 1 through 8 | Remove paper from locations shown |
| FLASHING YELLOW INDICATOR | |

TABLE I-continued

| | REMEDIAL ACTION REQUIRED |
|---|---|
| A Fuser oil level low | Add oil |
| B Toner cartridge empty | Replace toner cartridge |
| C Paper supply depleted | Replace paper roll |
| D Paper not loaded or loaded improperly in sheeter | Insert paper |

Thus in the event of a malfunction the copying machine stops operating. It stops immediately in the event of a paper jam, and continues to operate long enough to clear paper sheets from the machine in the event of depletion of a consumable item. At the same time the copying machine stops, the display 10 is illuminated in white. In the event of a paper jam a flashing red indicator at one of the locations 1 to 8 identifies where the jam was detected. Steadily illuminated red indicators at corresponding ones of the locations 1 to 8 show the location of paper sheets left along the paper flow path after the copying machine has stopped. These sheets must be removed before the copying machine can be restored to normal operation.

When the operator observes that the machine has stopped and the display 10 has illuminated, the copying machine access doors are opened to expose the elements symbolized by the diagram 10. As the paper sheets are removed from each sensor location, the corresponding indicators extinguish, one at a time. The flashing indicator (indicating where the jam was detected) continues to flash until the copying machine access doors are closed and the machine is caused to resume normal operation. At the time normal operation is resumed the flashing indicator and the entire display 10 is caused to extinguish.

Preferably, the copying machine logic should "remember" the number of copies which had been completed prior to occurrence of the malfunction, so that upon resumption of normal operation only the remaining ones of the desired number of copies will be made.

The operator performs in a similar manner when the machine shuts down as the result of depletion of a consumable item, although most of the time it will not be necessary to remove paper sheets from within the machine, as these sheets will have been cleared prior to shutdown of the machine.

Xerographic copier control and logic circuits for performing the aforementioned functions are well known in the art and are therefore not described here.

Figure 2:
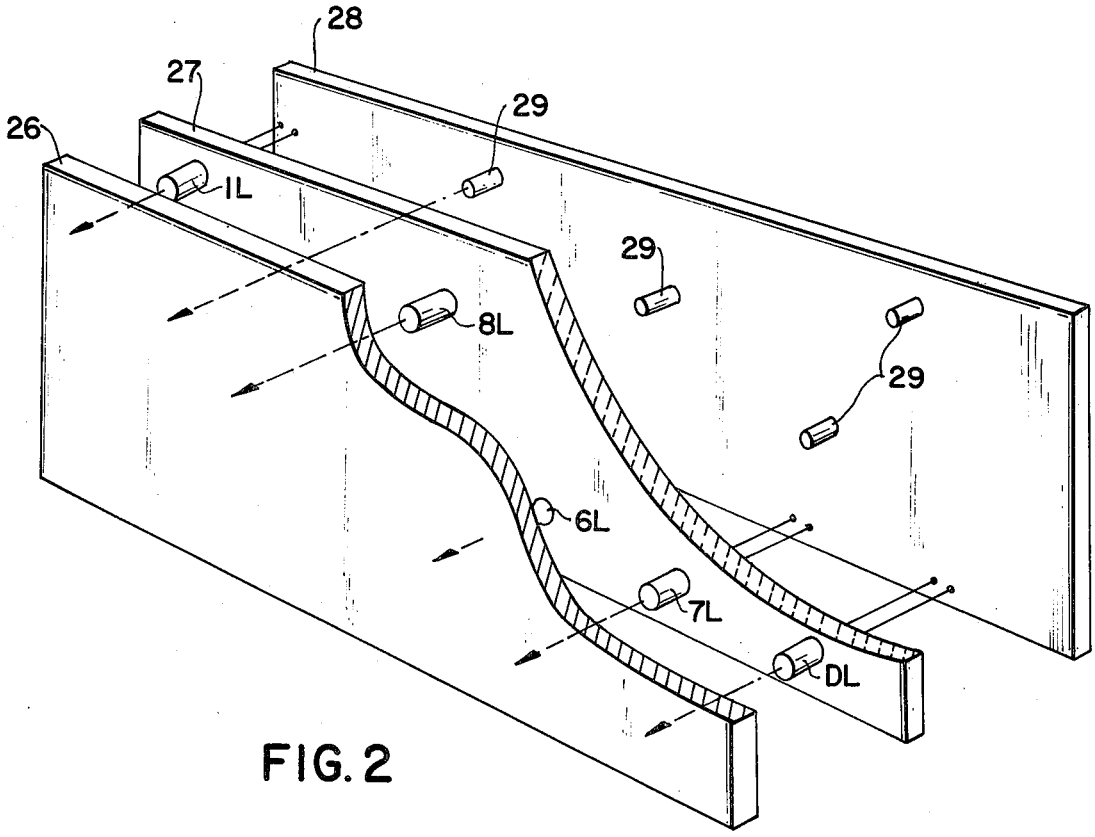
FIG. 2 is a partially cut-away perspective view illustrating the construction of the display of FIG. 1.

As illustrated in FIG. 2, the display 10 comprises a laminate of three plates, viz., (i) an opaque outer plate 26 of glass or a relatively hard plastic such as a polycarbonate, having transparent areas as shown in FIG. 1, (ii) a translucent diffuser plate 27 for providing overall illumination of the display 10, and a printed circuit board 28 having a plurality of incandescent lamps 29 mounted thereon for providing background illumination via the diffuser plate 27.

Red light emitting diodes (LED's) 1L to 8L are also mounted on the printed circuit board 28, and extend through adjacent holes in the diffuser 27 to assume positions adjacent corresponding ones of the transparent areas 1 to 8 of the display 10, i.e., of opaque panel 26. Similarly, yellow light emitting diodes AL to DL, corresponding to transparent areas A to D of the display 10, are mounted on the printed circuit board 28 and extend through adjacent holes in the diffuser 27 to assume positions adjacent the corresponding transparent areas of the display 10, i.e., of the opaque plate 26.

Figure 3:
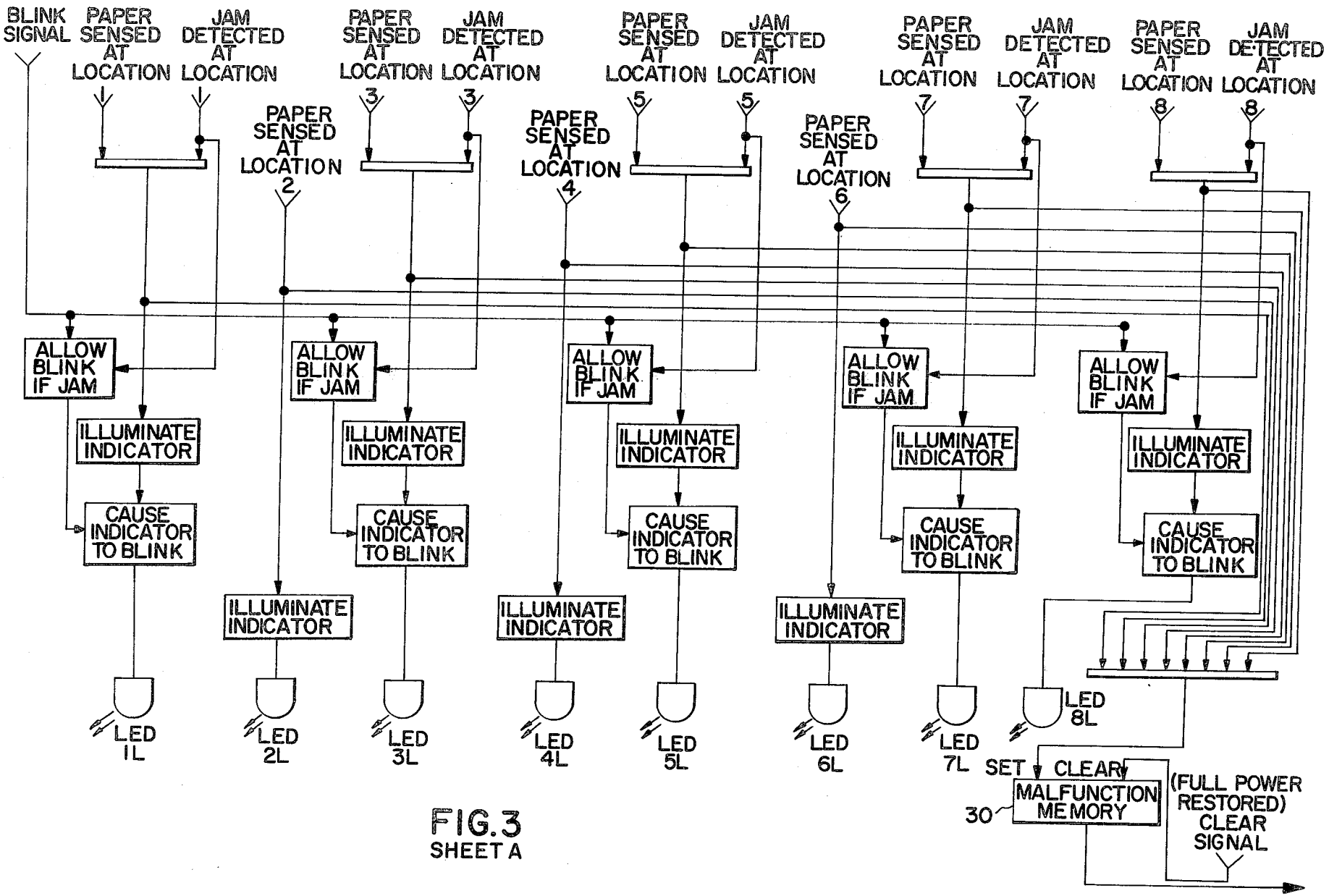
FIG. 3 is a functional logic diagram of the control circuitry for the display of FIGS. 1 and 2.
Figure 3:
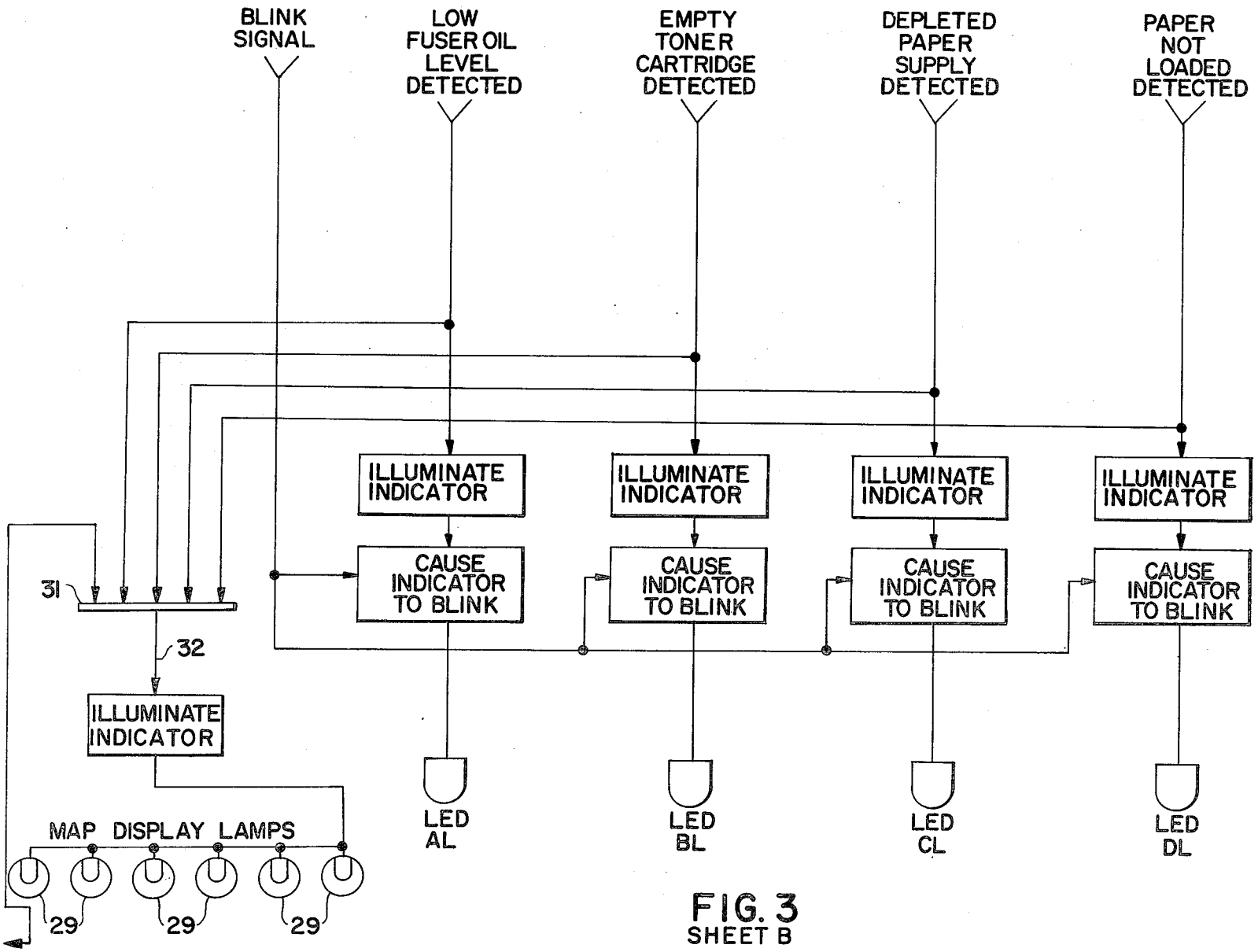

The logic circuitry for operating the light emitting diodes 1L to 8L and AL to DL, is relatively simple, and is functionally shown in FIG. 3. Since the sensors for detecting paper presence, paper jams and depleted levels of consumable items are well known in the art, these sensors are not shown in FIG. 3, and the outputs thereof are simply indicated at the top of said figure.

The "blink signal" of FIG. 3 is merely an oscillatory wave form which is capable of causing flashing of any light emitting diode to which said signal is coupled. The unlabeled horizontally oriented blocks of FIG. 3 represent OR gates. The numerical designations of locations in FIG. 3 correspond to the transparent areas having the same numbers in FIG. 1.

The "clear signal" of FIG. 3 is provided by conventional logic circuitry within the copying machine, coupled to the malfunction sensors, and appears when the malfunction has been corrected and the copying machine has resumed normal operation. This "clear signal" serves to reset the malfunction memory 30 to its quiescent condition, i.e., corresponding to normal machine operation.

The OR gate 31 generates a malfunction indicating signal on line 32 which causes the incandescent lamps 29 to illuminate the display 10 when a paper jam occurs, when the supply of paper, toner or fuser oil is depleted, or when the paper web from the roll 11 is not disposed along its proper path.

The malfunction memory 30 is a bistable circuit or its equivalent. Each of the blocks designated as an "Illuminate Indicator" in FIG. 3 is a transistor switch or its equivalent. Each of the blocks designated "Cause Indicator To Blink" and "Allow Blink If Jam" is a gate circuit. The logic circuitry shown in FIG. 3 may be realized by either hard wired logic or suitable software.

We claim:

1. In combination with an electrophotographic copying machine including:

(a) means for utilizing copy paper and other consumable items and for moving sheets of said copy paper along a predetermined path through said machine while forming visible images on said sheets, (b) jam detection means for monitoring the movement of paper sheets along said path at preselected points thereof, and for generating (i) a jam occurrence signal indicative of the occurrence of a paper jam along said path, and (ii) a jam location signal indicative of that one of said preselected points at which the jam was detected, (c) paper detection means for sensing the presence of paper sheets at various points along said path and for generating a number of paper presence signals indicative of the locations of corresponding paper sheets disposed along said path, and (d) consumable item monitoring means for sensing the quantity of each of said consumable items and for generating a depleted consumable item identification signal indicative of each particular item which has been depleted to a quantity less than a predetermined value, a malfunction display system comprising:

a pictorial display showing elements of said machine defining said paper path, said display including (i) paper path illuminating means for selectively illuminating portions of said display corresponding to each of said preselected points and each of said various points along said paper path, and (ii) consumable item symbols and means for selectively illuminating a point adjacent each of said symbols;

malfunction display enabling means responsive to said jam occurrence signal and to said depleted consumable item identification signals for illuminating said pictorial display;

jam display means responsive to said jam location signal for actuating said paper path illuminating means to distinctively illuminate the display portion corresponding to that one of said preselected points at which the jam was detected;

paper presence display means responsive to corresponding ones of said paper presence signals for actuating said paper path illuminating means to distinctively illuminate portions of said display corresponding to those of said various points along said paper path at which paper sheets are present; and depleted consumable item display means responsive to said depleted consumable item identification signals for distinctively illuminating points adjacent those symbols corresponding to consumable items requiring replenishment.

2. The combination according to claim 1, wherein said consumable items comprise paper and toner.

3. The combination according to claim 2, further comprising means for indicating on said display when paper is improperly loaded into said copying machine.

4. The combination according to claim 2, wherein said jam display means causes the illuminating means corresponding to said one preselected point to repetitively flash on and off.

5. The combination according to claim 2, wherein said paper path illuminating means has a first color and said means for selectively illuminating points adjacent said consumable item symbols has a second color.

6. The combination according to claim 2, further comprising means for deactivating said malfunction display enabling means after said jam occurrence, paper presence, and depleted consumable item identification signals terminate, and said copying machine resumes operation.

7. The combination according to claim 2, wherein said depleted consumable item display means causes the illumination of points adjacent each corresponding depleted consumable item symbol to repetitively flash on and off.

* * * * *